US007080754B2

(12) United States Patent
Lown

(10) Patent No.: US 7,080,754 B2
(45) Date of Patent: Jul. 25, 2006

(54) CONTAINER/HINGED LID ASSEMBLY

(75) Inventor: John M. Lown, Huntington Beach, CA (US)

(73) Assignee: Snapware Corporation, Mira Loma, CA (US)

( * ) Notice: Subject to any disclaimer, the term of this patent is extended or adjusted under 35 U.S.C. 154(b) by 6 days.

(21) Appl. No.: 10/850,938

(22) Filed: May 21, 2004

(65) Prior Publication Data

US 2005/0258180 A1 Nov. 24, 2005

(51) Int. Cl.
*B65D 43/14* (2006.01)

(52) U.S. Cl. ..... 220/835; 220/324

(58) Field of Classification Search ..... 220/840, 220/835, 843, 847, 845, 324, 810, 820, 844, 220/849, 848

See application file for complete search history.

(56) References Cited

U.S. PATENT DOCUMENTS

| | | | | |
|---|---|---|---|---|
| 1,471,195 | A | 10/1923 | Northern | |
| 4,809,874 | A | 3/1989 | Pehr | |
| 5,242,074 | A * | 9/1993 | Conaway et al. | 220/840 |
| 5,320,232 | A | 6/1994 | Maguire et al. | |
| 5,353,946 | A * | 10/1994 | Behrend | 220/326 |
| 5,464,115 | A * | 11/1995 | Tisbo et al. | 220/324 |
| D366,418 | S | 1/1996 | Lown | |
| 5,582,314 | A | 12/1996 | Quinn et al. | |
| 5,769,260 | A * | 6/1998 | Killinger et al. | 220/533 |
| 6,131,760 | A | 10/2000 | Huang | |
| 6,269,969 | B1 | 8/2001 | Huang et al. | |
| 6,273,258 | B1 | 8/2001 | Piacenza | |
| 6,669,049 | B1 * | 12/2003 | Crider | 220/833 |
| 6,918,508 | B1 * | 7/2005 | Hwang | 220/826 |
| 2002/0088813 | A1 | 7/2002 | Nyman et al. | |
| 2004/0159661 | A1 * | 8/2004 | Aochi | 220/264 |

* cited by examiner

*Primary Examiner*—Lien M. Ngo
(74) *Attorney, Agent, or Firm*—Harold L. Jackson

(57) ABSTRACT

A large mouth, integrally molded, one-piece container has a generally rectangular bottom wall and front and side walls extending upwardly and outwardly from the bottom to a rim with front and back sections joined to flat side handle sections. The upper central portions of the side walls deviate inwardly from the lower portions to form an undercut region under the handle sections to accommodate a user's fingers. A lid with a downwardly extending skirt overlying the container skirt in the closed position is hinged to the container back wall adjacent the rim. A latching tongue is integrally molded with the front skirt wall and includes a central section spaced outwardly from the skirt with a cooperating hook member formed on the lower end thereof.

6 Claims, 5 Drawing Sheets

CONTAINER/HINGED LID ASSEMBLY

FIELD OF THE INVENTION

The present invention relates to storage containers and more particularly to wide mouth containers suitable for storing food with a releasable hinged lid to accommodate dishwasher cleaning.

BACKGROUND OF THE INVENTION

Containers and lids for storing foodstuffs and the like are generally made of a plastic material such as polypropylene or polyethylene polymers or copolymers. Such containers and lids are normally fairly rigid, but may be subject to some amount of flexure especially where the lid or cover is arranged to be peeled off of the container mouth. Most such container/lid configurations provide a sealing bead or rim along the upper wall of the container with a mating channel on the lid which engages the bead as well as the adjacent inner and outer surfaces of the container wall. Such sealing arrangements generally require considerable effort to force the lid onto the sealing bead during the closing procedure and perhaps greater effort to peal the lid away from the container during the opening process. The opening procedure for such container/lid configurations may be quite difficult for a person suffering from arthritis or tendinitis.

Large mouth food storage containers with hinged cap assemblies, for example, of the type disclosed in U.S. Pat. No. 5,582,314 are also available. Such cap assemblies are formed of a cap body arranged to screwed onto the mouth of the container with a lid hinged to the cap body. The containers designed for use with such cap assemblies are generally designed to be grasped around a portion of the cross-sectional circumference of the container body. A person suffering from arthritis or tendinitis may find it difficult to hold and transport such container. In addition, prior art container/cap assemblies require three parts, i.e., a cap body, a lid and a container unless the hinge between the cap body and the lid is a living hinge, i.e., molded integrally with the cap and lid, in which case the lid cannot be separated from the cap body. Even in the absence of a living hinge arrangement it may be difficult for a user to separate the lid from the cap body.

There is a need for a simple wide mouth food stuff storing container/lid combination with a user friendly handle at the top of the unit and a lid which is hinged directly to the container in which hinge is easily detached for accommodating dishwasher cleaning.

The construction and feature of the present invention may best be understood by reference to the following description taken in conjunction with the appended claims.

SUMMARY OF THE INVENTION

A large mouth container/hinged lid assembly includes an integrally molded one-piece container having a generally rectangular bottom wall and front, back and side walls extending upwardly and outwardly from the bottom to a rim with front and back sections joined to substantially flat side handle sections. The upper portions of the side walls deviate inwardly from the lower portions thereof to form an undercut region under the handle portions to accommodate a user's fingers. A protruding latch hook is formed on the front wall adjacent the rim and one-half of a hinge connection is formed on the back wall adjacent the rim.

An integrally molded, one-piece lid, with a top wall, merged to a downwardly extending peripheral skirt, overlies the container rim in a closed position. A latching tongue, integrally molded with the front wall of the skirt, has a central section spaced outwardly from the skirt. The tongue includes a downwardly extending finger engaging section having an inner hook member for engaging the latch hook on the container front wall. The lid has an inner flange on the under side which, with the inner wall of the skirt, defines a gasket groove for receiving a generally annular gasket. The back wall of the lid defines the second half of a hinge connection.

DETAILED DESCRIPTION OF THE DRAWINGS

Figure 4:
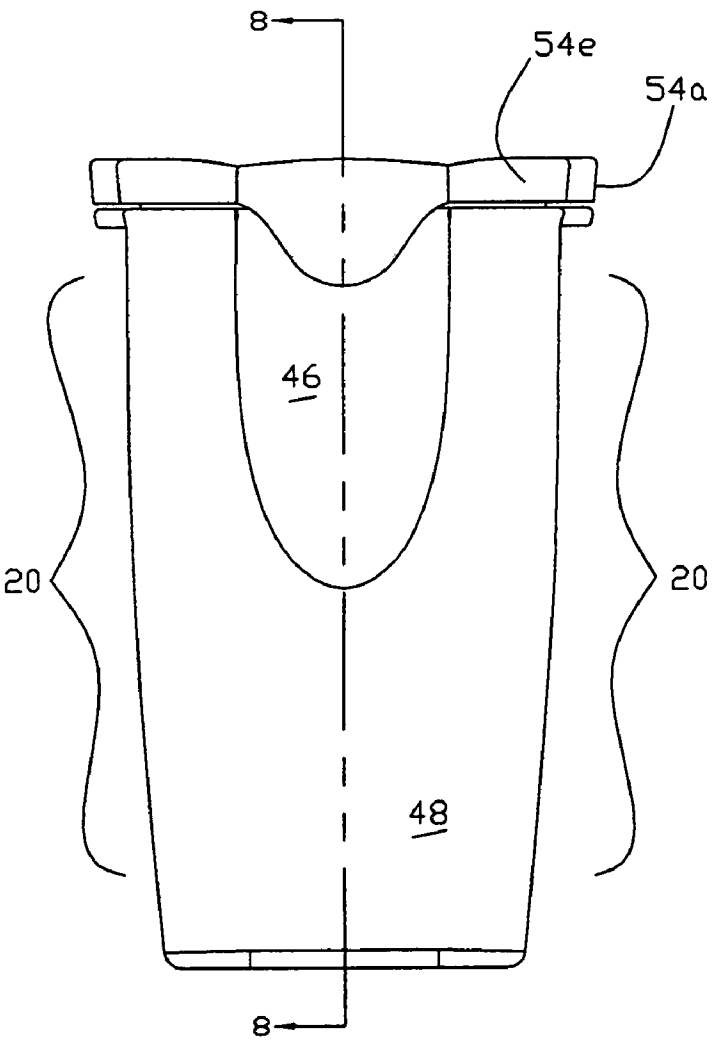
FIG. 4 is a front elevational view of the assembly.
Figure 3:
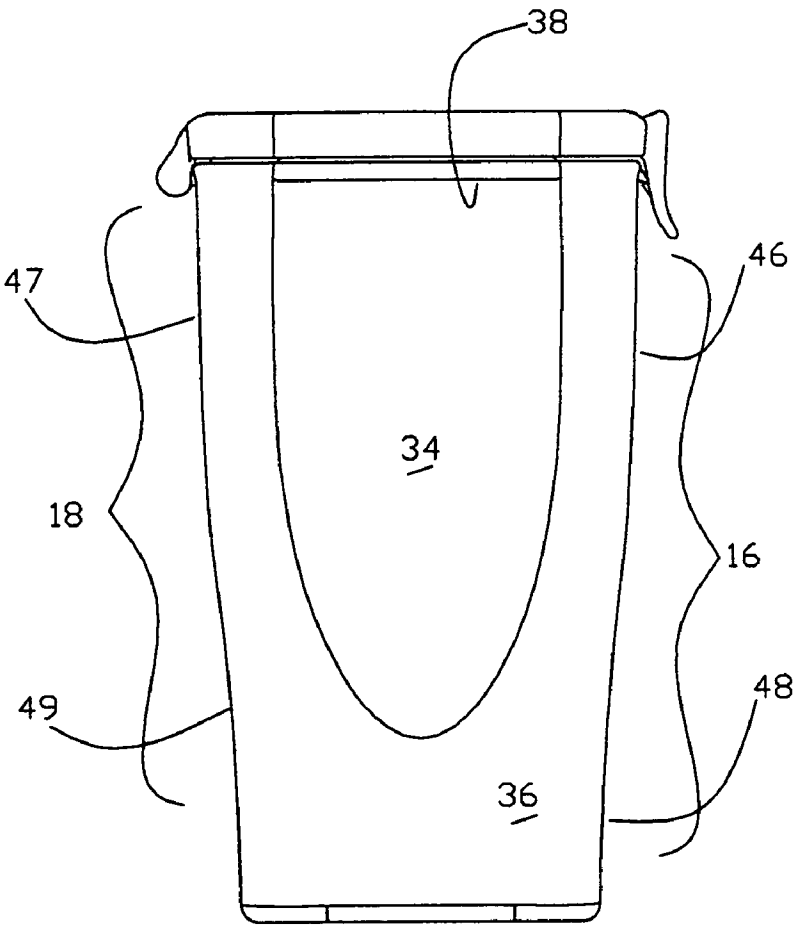
FIG. 3 is a side elevational view of the assembly showing the latch and hinge on opposite sides of the container.

Referring now to the drawings and particularly to FIGS. 1–5 an integrally molded one-piece lid 10 is connected to an integrally molded one-piece container 12 via a breakaway hinge (to be described). The container has a generally rectangular bottom wall 14 with front and back walls 16 and 18, respectively and side walls 20 (FIG. 4). The walls extend upwardly with a small outward angle of inclination, e.g, about 2°–4°, with respect to the vertical, and terminate in a rim 22 surrounding an open mouth 24 (FIG. 5) through which food stuffs or other items may be placed in the container. The rim is formed by front (26) and back (28) sections joined to substantially flat, generally elliptically-shaped, side handle sections 30. The handle sections have a convex peripheral edge 32.

Figure 2:
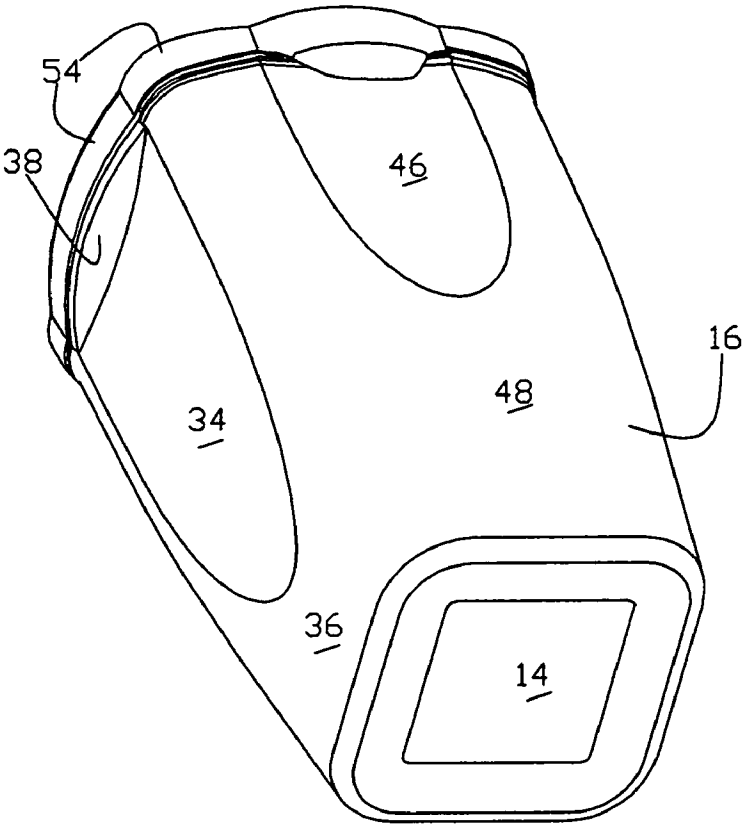
FIG. 2 is a perspective view of the assembly of FIG. 1 from a bottom angle.
Figure 1:
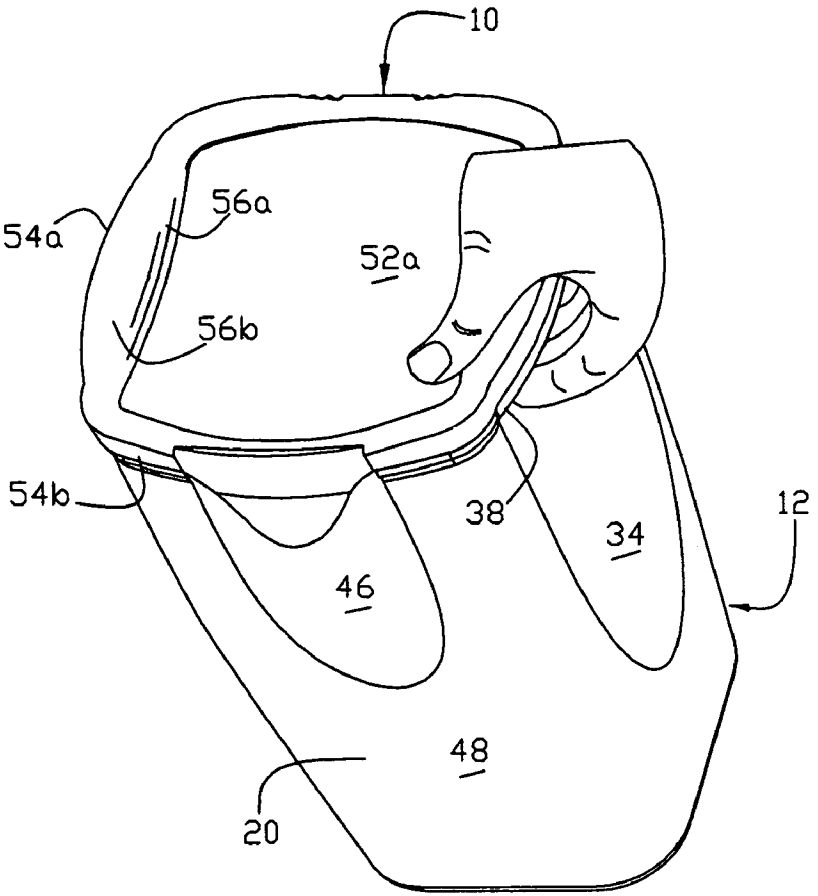
FIG. 1 is a perspective view of the container/lid assembly of the present invention showing a facsimile of person's hand grasping one of the handle sections of the assembly.
Figure 6:
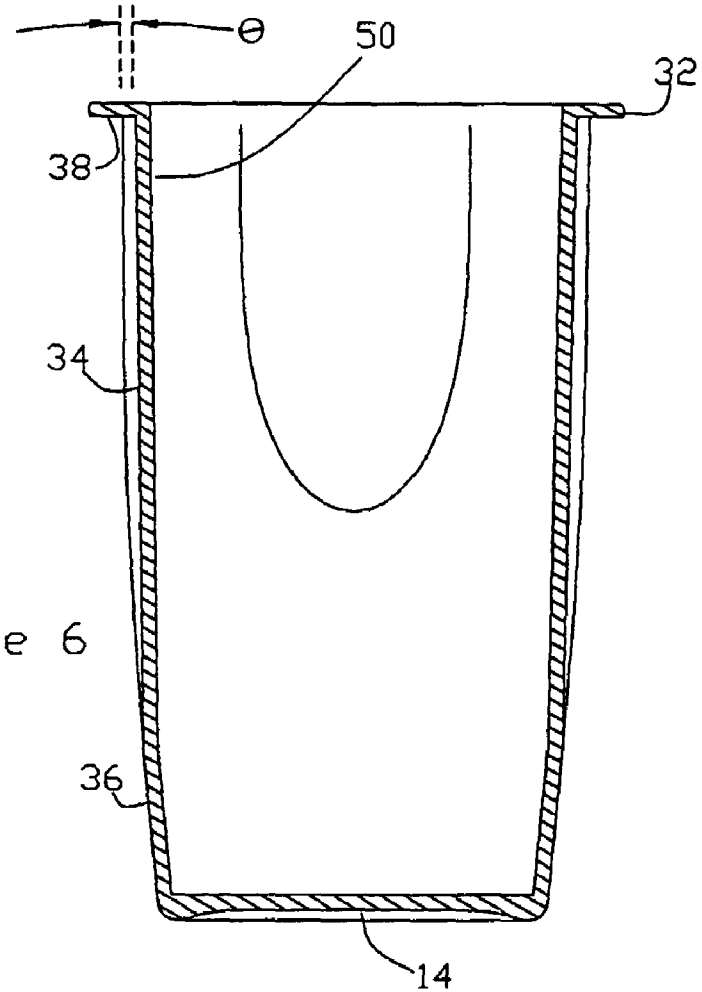
FIG. 6 is a cross-sectional view of the container showing the deviation of an upper side portion of the container wall from the outward inclination of the lower side portion to form a handle section.

An upper central portion 34 of the side walls deviate inwardly at an angle θ (e.g., within the range of about 1° to 4° and preferably about 2°, FIG. 6) from the outward inclination of the lower portion 36 thereof to form an undercut region 38 underlying the handle sections 30 to accommodate a user's finger for grasping and holding the container as is illustrated in FIG. 1. The central portions 34 of the side walls may be approximately vertically oriented. The upper central portions 46 and 47 of the front and back walls, respectively, leading to the rim also deviate inwardly from the inclination of the lower portions 48 and 49, respectively to compliment the scalloped side wall portions 34 and enhance the aesthetic appearance of the container. See FIGS. 3 and 4. The end 50 of the upper portions 34

(underlying the handle sections 30) preferably forms a curved concave line or surface (symmetrical about a vertical axis) to provide an increased handle area. See FIG. 5. A outwardly projecting latch hook 26*a* is formed on the front rim portion 26 for receiving a latching tongue hook member formed on the lid as will be explained.

The lid 10 is formed with a centrally disposed top surface 52*a* merged with a downwardly extending peripheral skirt 54 overlying the edge of the container rim when the lid is in a closed position as is illustrated in FIG. 1. Preferably the merger between the top surface 52*a* and the skirt portion 54*a*, overlying the container handle sections, is in the form of an upwardly inclined section 56*a* joined to a substantially flat section 56*b* to provide a suitable purchase area for a user's fingers in lifting and transporting the assembled container/lid. Skirt portions 54*b* and 54*c* are located at the front and back of the lid as illustrated in FIGS. 7 and 8.

Figure 8:
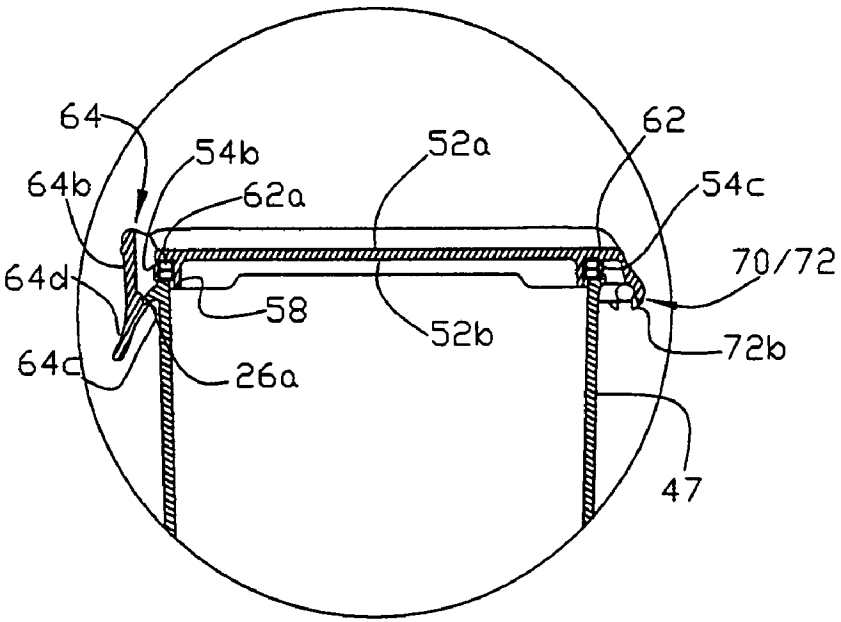
FIG. 8 is a cross-sectional view of the assembly taken along lines 8—8 of FIG. 4.

The lower surface of the lid includes a centrally disposed surface 52*b* underlying the top surface 52*a* as is illustrated in FIG. 8. An inner flange 58, following the contour of the skirt 54, is formed on the underside of the lid to define a channel 60 with the inner surface of the skirt for receiving a gasket 62. See FIGS. 7 and 8. The gasket 62 is molded of a suitable elastomeric material with internal passageways 62*a* to allow the gasket to be readily compressed forming a seal between the lid and container rim when the lid is in its closed position.

A latching tongue 64 has end portions 64*a* molded integrally with the front skirt wall 54*b* (FIG. 7) with a central section 64*b* spaced outwardly from the wall 54*b*. The latching tongue includes an inwardly projecting horizontally extending hook member 64*c*, the underside of which engages the latch hook on the container in the closed and sealed position as is illustrated in FIG. 8. The opening 66 between the latching tongue 64 and the front skirt wall 54*b* enables the lid to be made with a two piece mold, without the need for a slidable member in the mold to accommodate the hook member 64*c*. The latching tongue is formed with a downwardly extending finger engaging tab 64. The free center 64*b* of the latching tongue, in addition to simplifying the molding process, enables the lid to be easily opened by one suffering from arthritis, for example, while preserving the sealing function in the closed position. It is to be noted that the latch hook may be formed on either the front wall of the container or on the inside of the latch tongue with a cooperating hook member formed on the other.

Figure 5:
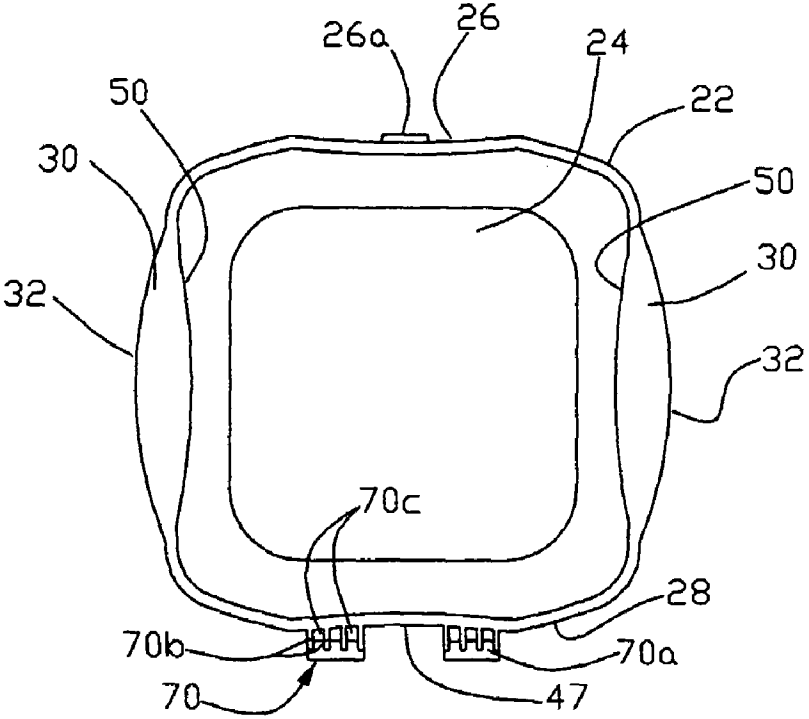
FIG. 5 is a top plan view of the container with the lid removed.
Figure 7:
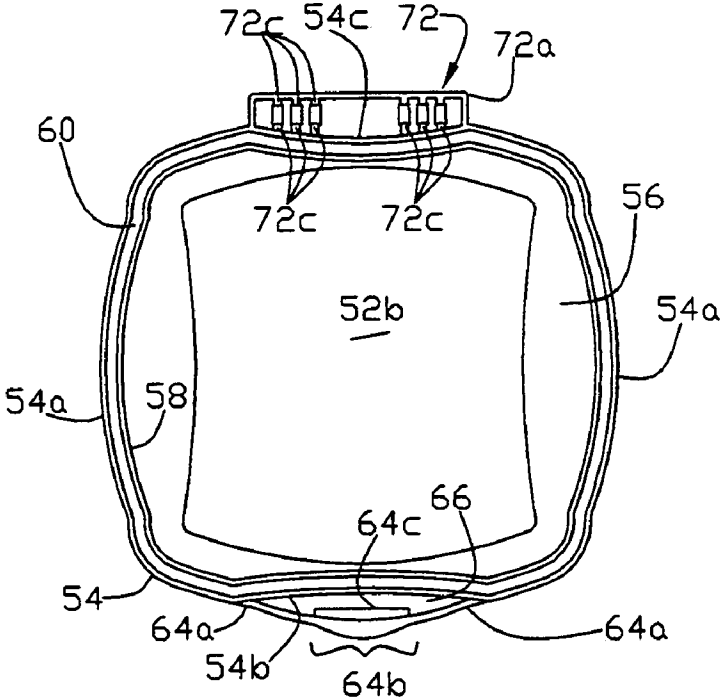
FIG. 7 is a bottom view of the lid.

Referring now to FIGS. 5 and 7–9, a breakaway hinge connection, between the lid and container, is formed of a first portion 70 comprising an axle 70*a* spaced outwardly from the central upper section 47 of the back wall 28 of the container via horizontally extending support arms 70*b* leaving rectangular openings 70*c* between the axle, the back wall portion 47 and the support arms as illustrated in FIG. 5. The second mating/portion 72 of the hinge comprises a bracket 72 molded integrally with the rear skirt 54*c* with the bracket having a rearward plate 72*a* defining a lower horizontal free edge 72*b* (FIG. 9) spaced from the skirt. The bracket 72 includes a plurality of horizontally spaced, i.e., 6, hinge fingers 72*c*, with the individual fingers encompassing an angle in excess of 180° and being arranged to releaseably snap over the axle 70*a*. The proximal side 72*c*' of the fingers (adjacent the container wall) are arranged to rotate within respective openings 70*c* in the hinge portion 70 when the lid is rotated from an open position (FIG. 10) to a closed position (FIGS. 7 and 8). The back container wall portion 47, between the arms 70*b*, prevents the proximal side 72*c*' of the fingers 72*c* from flexing away from the axle when the lid is rotated to it's closed position thereby maintaining the gasket in sealing engagement with the container rim.

Figure 10:
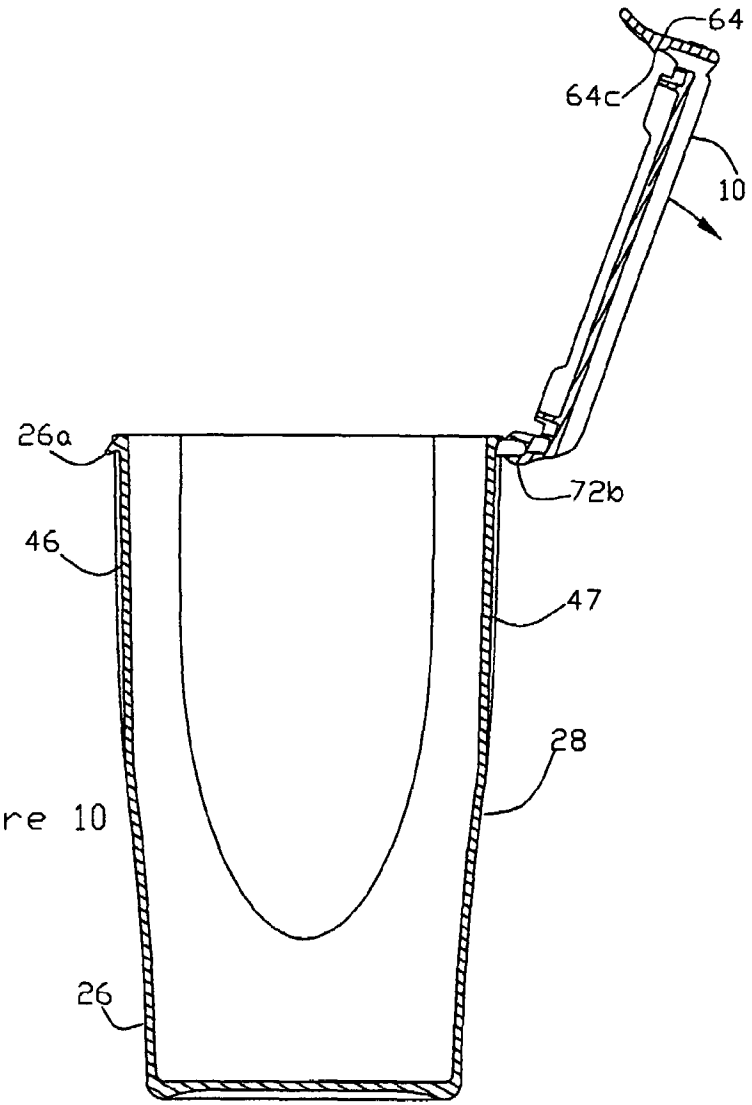
FIG. 10 is a cross-sectional view of the assembly showing rotation of the lid prior to the removal thereof.
Figure 9:
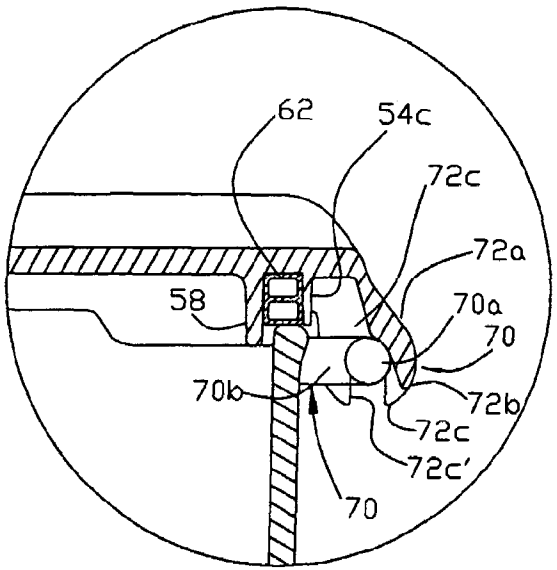
FIG. 9 is an enlarged cross-sectional partial view of the assembly showing the hinge and sealing gasket.

The bracket free edge 72*b* is arranged to engage the back wall portion 47, adjacent the rim, when the lid is rotated to its full open position, e.g., about 120°, as is illustrated in FIG. 10. Further, rotation of the lid will cause the hinge portions to separate resulting in a breakaway hinge. The breakaway hinge arrangement enables a user to quickly remove the lid for cleaning purposes and reestablish the hinge connection after cleaning by simply snapping the fingers 74 over the axle while the lid is positioned as illustrated in FIG. 9.

There has thus been described an esthetically pleasing and user friendly hinged container/lid assembly which may be molded of suitable plastic materials such as polypropylene or polycarbonate. Various modifications to the assembly will occur to those skilled in the art without involving any departure from the spirit and scope of the invention as defined in the appended claims.

What is claimed is:

1. A large mouth container/hinged lid assembly comprising:

an integrally molded one-piece container having a generally rectangular bottom wall and front, back and side walls extending upwardly and outwardly from the bottom and terminating in a rim surrounding an open mouth, the rim having front and back sections joined to substantially flat side handle sections having an outer convex edge, an upper portion of the side walls deviating inwardly from the outward inclination of a lower portion thereof to form an undercut region forming a concave surface under the handle sections to accommodate the placement of a user's fingers under the handle sections, and an upper portion of the back wall defining a first portion of a hinge connection;

an integrally molded one-piece lid having a top wall merged with a downwardly extending peripheral skirt overlying the rim of the container in a closed position, the skirt having front, back and side walls, a latching tongue member having end sections formed integrally with the front wall of the skirt and a central downwardly extending finger engaging section spaced from the skirt, the back wall of the skirt defining a second portion of a hinge connection, the hinge connection being arranged to separate through rotation of the lid in an open position beyond a predetermined angle allowing the hinge connection to subsequently be reestablished, the lid further having an inner flange defining a gasket receiving channel with a peripheral skirt, one of the latching tongue member and front wall portion of the container having a protruding latch hook and the other having a cooperating hook member to effect closure of the lid; and a gasket disposed in the gasket receiving channel for engaging and sealing against the rim of the container in a closed position.

2. The assembly of claim 1 wherein the upper portion of the container side walls deviate through an angle θ from the lower portion of the side walls with θ being within the range of about 1° to 4°.

3. The assembly of claim 1 wherein the first hinge connection portion is formed by the axle which is supported by a plurality of horizontally extending support arms defining vertically oriented openings therebetween.

4. The assembly of claim 3 wherein the second hinge connection portion is formed by a bracket carried by the back wall of the skirt and defining a plurality of vertically oriented fingers arranged to releasably snap over the axle and extend within the openings between the support arms.

5. The assembly of claim 4 wherein the back wall of the bracket includes a lower free edge arranged to engage the upper portion of the container back wall removing the fingers from the axle when the lid is rotated beyond said predetermined angle.

6. A large mouth container/hinged lid assembly in which the lid is arranged to pivot between an open position to provide access to the container and a closed position in which the lid seals the container opening comprising:

an integrally molded one-piece container having a bottom wall with front, back and side walls extending upwardly and outwardly at an angle θ from the bottom wall and terminating in an open rim, the rim having front and back sections, with corners joined to substantially flat handle sections, an upper portion of the side walls between the corners being generally vertically inclined to form an undercut region under the handle sections to accommodate a user's fingers in holding the container, an upper portion of the front wall having an outwardly projecting latch hook, and an axle spaced from the back wall adjacent the rim;

an integrally molded, one-piece, lid having a top wall merged with a downwardly extending peripheral skirt overlying the container rim in the closed position, the skirt having front, back and side walls, a latching tongue having a central section spaced from the front skirt wall with a downwardly extending finger engaging section and an inwardly projecting hook member for engaging the latch hook when the lid is in the closed position, a plurality of spaced axle engaging fingers carried by the skirt back wall for snapping over the container axle to form the hinge connection, the axle engaging fingers being arranged to separate from the axle when the lid is rotated beyond a predetermined angle, the lid further defining a gasket receiving channel adjacent the inner surface of the skirt; and a flexible gasket disposed in the channel.

* * * * *